US006516470B1

(12) United States Patent
Aoki

(10) Patent No.: US 6,516,470 B1
(45) Date of Patent: Feb. 11, 2003

(54) BALL CATCHING TOOL

(75) Inventor: Akio Aoki, Hirakata (JP)

(73) Assignee: Trion Corporation, Osaka (JP)

( * ) Notice: Subject to any disclaimer, the term of this patent is extended or adjusted under 35 U.S.C. 154(b) by 0 days.

(21) Appl. No.: 10/066,260

(22) Filed: Feb. 1, 2002

(51) Int. Cl.[7] ..... A41D 13/08
(52) U.S. Cl. ..... 2/19; 2/161.1
(58) Field of Search ..... 2/19, 16, 20, 159, 2/160, 161.1, 161.3, 161.4, 161.5, 161.6, 162, 169, 170; 473/205, 300, 451, 458, 464

(56) References Cited

U.S. PATENT DOCUMENTS 4,527,287 A * 7/1985 Aoki ..... 2/161.1
6,249,915 B1 * 6/2001 Hang ..... 2/19
6,347,402 B1 * 2/2002 Aoki ..... 2/19

* cited by examiner

*Primary Examiner*—Gary L. Welch
(74) *Attorney, Agent, or Firm*—Fulbright & Jaworski L.L.P.

(57) ABSTRACT

A ball catching tool including a joint outer leather portion for blocking and jointing an outer leather portion on a hand inserting side and a main outer leather portion on a finger side, wherein the joint outer leather portion includes a plurality of strip-like outer leather pieces with longitudinal directions of the respective pieces being aligned to extend from the main outer leather portion on the finger side to the outer leather portion on the hand inserting inlet side to be entirely aligned in width directions of the hand and with respective outer leather pieces being fixed at both ends in longitudinal directions of the pieces without being tightly bonded in width directions of the hand.

6 Claims, 6 Drawing Sheets

BALL CATCHING TOOL

BACKGROUND OF THE INVENTION

1. Field of the Invention

The present invention relates to a ball catching tool as used for playing baseball or softball or the like, and particularly to a ball catching tool with outer leather parts on a rear side of a main body of the ball catching tool being formed to cover a back of one's hand while an outer leather portion on a hand inserting inlet side for receiving and supporting a wrist side of the back of one's hand is arranged that it may be freely tightened or released from a tightened condition with respect to one's hand.

2. Description of the Related Art

A ball catching tool with outer leather parts on a rear side of a main body of the ball catching tool being formed to cover a back of one's hand while an outer leather portion on a hand inserting inlet side for receiving and supporting a wrist side of the back of one's hand is arranged that it may be freely tightened or released from a tightened condition with respect to one's hand is conventionally known for use as a ball catching tool in playing baseball. When using such a ball catching tool, the outer leather portion on a hand inserting inlet side, which is connected to a main outer leather portion on the finger side, is tightened to one's hand for restricting the ball catching tool from slipping off from one's hand or from a positional shift thereof with respect to the hand when catching a ball for thus enabling easy catching.

However, such a ball catching tool presented the following drawbacks due to the arrangement of tightening the outer leather portion on a hand inserting inlet side, which is connected to the main outer leather portion on the finger side, with respect to one's hand.

That is, when the ball catching tool in a condition in which it is attached to one's hand, the outer leather portion on a hand inserting inlet side that is tightened to the hand hardly allows any positional changes in a longitudinal direction of the hand owing to its tightening force. When one tries to bend each finger when performing catching, tension force preventing deformation of the main outer leather portion in a warping manner will be applied from the outer leather portion on a hand inserting inlet side to the main outer leather portion accompanying catching operations so that the main outer leather portion will be in a restrained condition. The main outer leather portion will thus hardly be deformed in a warping manner so that it would often happen that it was difficult to catch while firmly bending each finger.

One possible measure would be to form only the outer leather portion between the main outer leather portion on the finger side and the outer leather portion on a hand inserting inlet side on the wrist side by using an elastic material for avoiding tension force that prevents deformation of the main outer leather portion in a warping manner accompanying catching operations through this elastic material and enabling easy deformation of the main outer leather portion in a warping manner. However, such a measure is not appropriate since it leads to another drawback that partial degradation in strength is caused at a portion of the elastic material portion which strength is inferior to that of the outer leather parts.

SUMMARY OF THE INVENTION

The present invention has been made in view of the above circumstances, and it is an object thereof to provide a ball catching tool that enables easier catching operations while being of an arrangement in which an outer leather portion on a hand inserting inlet side for receiving and supporting a wrist side of the back of one's hand is arranged that it may be freely tightened or released from a tightened condition with respect to one's hand.

More particularly, the characteristic arrangement of the ball catching tool according to the present invention is comprised of:

a main body of the ball catching tool with outer leather parts on a rear side being formed to cover a back of one's hand while an outer leather portion on a hand inserting inlet side for receiving and supporting a wrist side of the back of one's hand is arranged that it may be freely tightened or released from a tightened condition with respect to one's hand, and a joint outer leather portion that is provided at the main body of the ball catching tool for blocking and jointing the outer leather portion on the hand inserting side and a main outer leather portion on a finger side, wherein the joint outer leather portion includes a plurality of strip-like outer leather pieces with longitudinal directions of the respective pieces being aligned to extend from the main outer leather portion on the finger side to the outer leather portion on the hand inserting side to be entirely aligned in width directions of the hand and with respective outer leather pieces being fixed at both ends in longitudinal directions of the pieces without being tightly bonded in width directions of the hand.

The following actions and effects may be exhibited through the above arrangement.

[a] One's hand is inserted from the hand inserting inlet into the main body of the ball catching tool, and the outer leather portion on the hand inserting inlet side is tightened and attached to the hand. With this arrangement, it is possible to reliably prevent slipping off of the ball catching tool from the hand or positional shift thereof with respect to the hand when performing catching operations.

[b] When the tool is in a condition in which it is attached to one's hand as in [a] above, the outer leather portion on a hand inserting side that is tightened to one's hand may hardly be changed in position in a longitudinal direction of the hand through its tightening force with respect to the hand. However, according to the arrangement of the present invention, the joint outer leather portion blocking and jointing the outer leather portion on the hand inserting inlet side and a main outer leather portion on a finger side is comprised of a plurality of strip-like outer leather pieces with longitudinal directions of the respective pieces being aligned to extend from the main outer leather portion on the finger side to the outer leather portion on the hand inserting side entirely aligned in width directions of the hand and with respective outer leather pieces being fixed at both ends in longitudinal directions of the pieces without being tightly bonded in width directions of the hand, and restraining force of the outer leather portion on the hand inserting side acting onto the main outer leather portion that tries to deform to warp accompanying the bending of each finger at the time of catching is restricted at intermediate of the strip-like outer leather pieces of the joint outer leather portion. In other words, the main outer leather portion will be substantially separated from the outer leather portion on the hand inserting side which position is hardly changeable accompanying the catching operations so that the main outer portion will be readily bend to a palm side and may be easily deformed in a warping manner.

[c] The above arrangements [a] and [b] enable it to perform catching while firmly bending each finger so as to enclose a ball with inner leather parts corresponding to the palm side of the main body of the ball catching tool.

[d] In the joint outer leather portion comprised of strip-like outer leather pieces, the outer leather pieces are of a strength that approximates that of the remaining outer leather portions, no partial degradations in strength of the outer leather parts will occur at the joint outer leather portion.

Thus, according to the present invention, it is possible to provide a ball catching tool that enables easy catching while being of an arrangement in which an outer leather portion on a hand inserting side for receiving and supporting a wrist side of the back of one's hand is arranged that it may be freely tightened or released from a tightened condition with respect to one's hand.

It is preferable that the joint outer leather portion is arranged in that adjoining strip-like outer leather pieces are connected on a rear side of the outer leather pieces by means of a sheet material exhibiting elasticity.

The following actions and effects may be exhibited through the above arrangement.

[e] Since adjoining outer leather pieces are connected by means of an elastic sheet material so that the outer leather pieces are pulled to the back of one's hand through the elasticity of the elastic sheet material when the fingers are bend, the joint outer leather portion will favorably fit to the back of one's hand without escaping so as to enable reliable catching operations.

[f] Since the elastic sheet material connecting the outer leather pieces exhibits elasticity, the respective outer leather pieces will not be firmly bonded with respect to width directions of the hand, and the elastic sheet material will be of no hindrance in restricting the restraining force acting from the outer leather portion on the hand inserting side.

[g] The elastic sheet material formed on the rear side of the outer leather pieces will not be damaged since it is continuously protected by the outer leather pieces.

It is accordingly possible to provide a ball catching tool with which balls may be more easily caught.

It is preferable that the joint outer leather portion is arranged in that the respective strip-like outer leather pieces are arranged such that longitudinal directional edges on the finger side of outer leather pieces that are located farther away from the fingers are slipped under longitudinal directional edges on the opposite side of the fingers of the outer leather pieces that are located closer to the fingers in a partially overlapping manner, wherein the outer leather pieces that are closest to the fingers are joint to the main outer leather portion in a condition in which their longitudinal directional edges on the finger side are slipped under an end edge of the main outer leather portion in a partially overlapping manner whereas the outer leather pieces that are farthest from the fingers are joint to the outer leather portion on the hand inserting side in a condition in which an end edge of the outer leather portion on the hand inserting side is slipped under their longitudinal directional edges in a partially overlapping manner.

The following actions and effects may be exhibited through the above arrangement.

[h] Partial overlaps of the outer leather parts in which the finger side is formed upward and the hand inserting side is formed downward are formed between the strip-like outer leather pieces, between the outer leather piece that is closest to the fingers and the main outer leather portion, and between the outer leather piece that is farthest from the fingers and the main outer leather on the hand inserting side. Since these partial overlaps of outer leather parts are directed in a direction that is in line with a direction of movements of the opposite sided hand held in position or of movements of an approaching ball (forward direction), the outer leather pieces will not stand on end to be a hindrance at the time of holding the ball catching tool in position or of performing catching, and catching may be reliably performed.

It is preferable to employ an arrangement in which the longitudinal directional edge on the finger side of the outer leather piece that is closest to the fingers are jointed by fastening these to the end edge of the main outer leather portion, and in which the longitudinal directional edge on the finger side of the outer leather piece that is farthest from the fingers and the outer leather portion on the hand inserting side are jointed upon being connected on the rear side of the outer leather pieces through an elastic sheet material.

The following actions and effects may be exhibited through the above arrangement.

[i] The longitudinal directional edge on the finger side of the outer leather piece that is closest to the fingers is jointed by fastening the same to the end edge of the main outer leather portion, and the longitudinal directional edge on the finger side of the outer leather piece that is farthest from the fingers is connected to the outer leather portion on the hand inserting side through an elastic sheet material on the rear side of the outer leather pieces, and since the outer leather piece that is closest to the fingers and the outer leather piece that is farthest from the fingers are pulled towards the back of one's hand when the fingers are bent which is affected by mounting the same to the main outer leather portion and by the elasticity of the elastic sheet material, the joint outer leather portion will not escape but favorably fit the back of one's hand to ensure catching operations.

[j ] Even though the outer leather portion that is closest to the fingers is fastened to the main outer leather portion, the restraining force acting from the outer leather portion on the hand inserting side will be restricted until it reaches the outer leather portion that is closest to the fingers, and even though the outer leather portion that is farthest from the fingers is fastened to the outer leather portion on the hand inserting side, the restraining force acting from the leather portion on the hand inserting side will be restricted through the elasticity of the of the elastic sheet material connecting both members.

[k] Since the elastic sheet material located on the rear side of the outer leather pieces and the outer leather portion on the hand inserting side will not be damaged since it is continuously protected by the outer leather pieces and the outer leather portion on the hand inserting side.

It is preferable that it (the joint outer leather portion) is comprised of not more than four strip-like leather pieces.

The following actions and effects may be exhibited through the above arrangement.

[l] Since the number of outer leather pieces that comprise the joint outer leather portion is limited to a small number of not more than four pieces for the purpose of eliminating troublesome processing of the joint outer leather portion, it is possible to easily manufacture the same. In case the number of outer leather pieces that comprise the joint outer leather portion exceeds four, processing of the joint outer leather portion will become troublesome so as to increase its manufacturing costs.

DETAILED DESCRIPTION OF THE PREFERRED EMBODIMENTS

Embodiments of the ball catching tool according to the present invention will now be explained in details with reference to the drawings.

[The First Embodiment]

Figure 1:
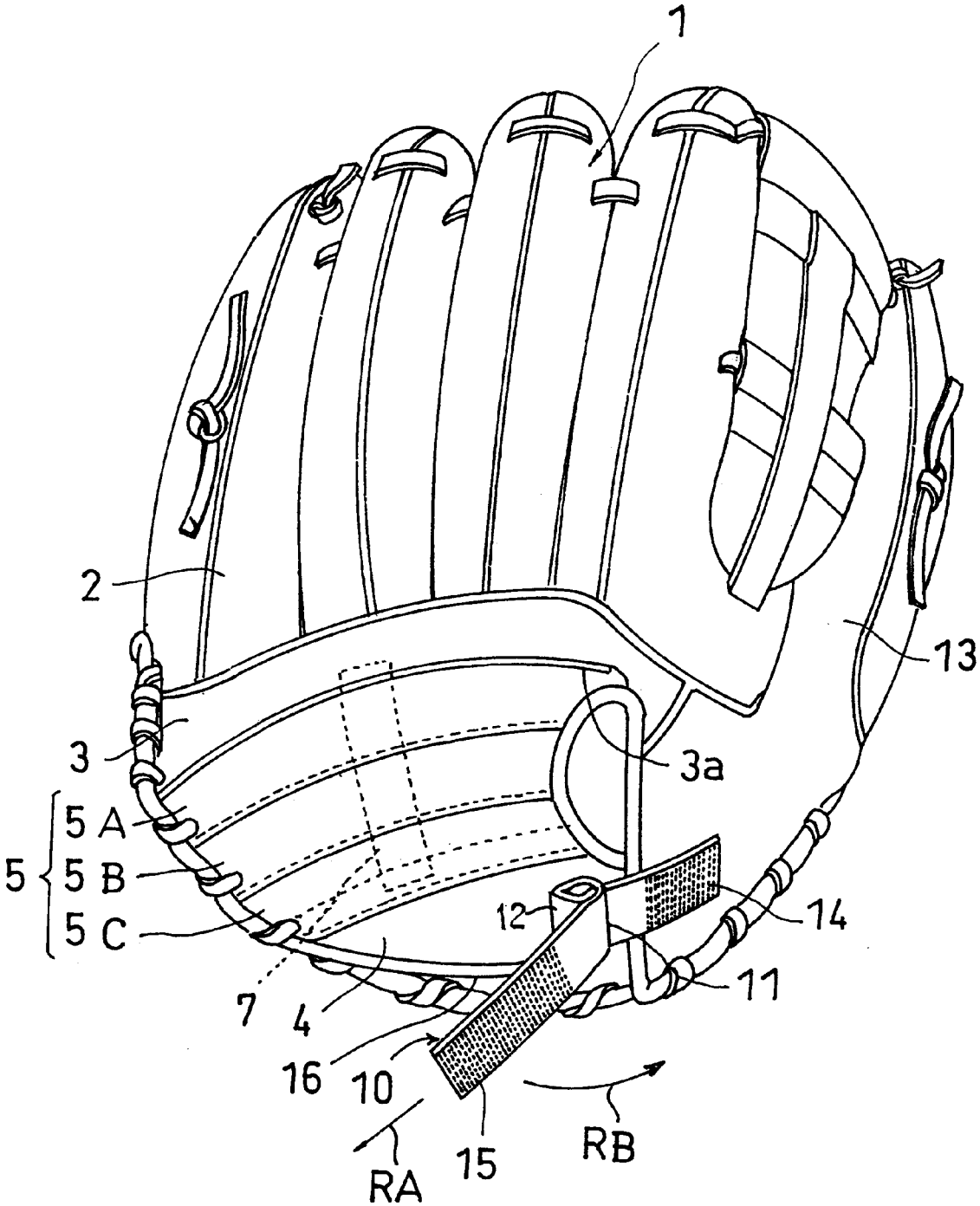
FIG. 1 is a rear view of a ball catching tool according to a first embodiment.
Figure 2:
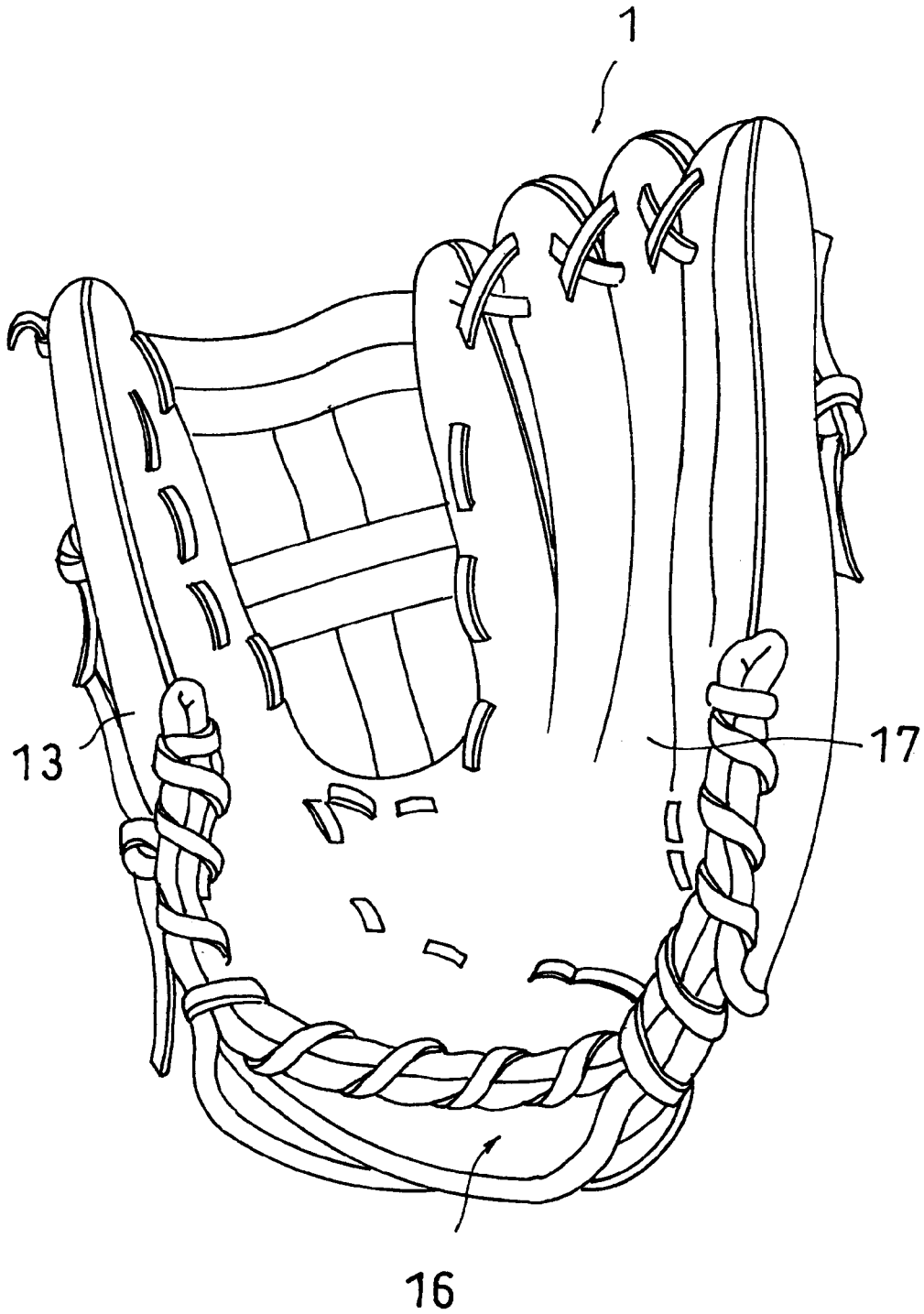
FIG. 2 is a perspective view illustrating an inner leather side of the ball catching tool.
Figure 3:
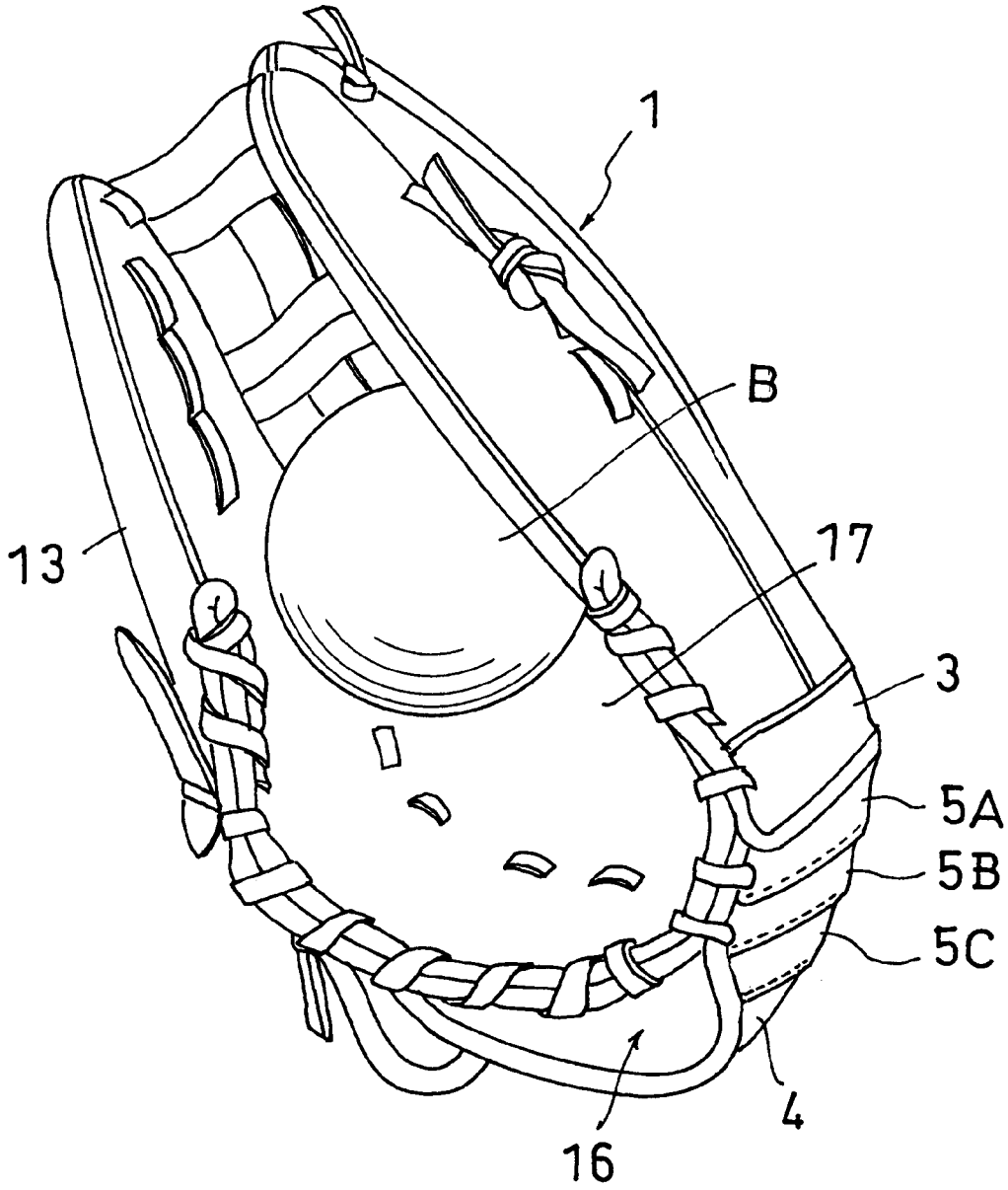
FIG. 3 is a perspective view illustrating the ball catching tool in a ball catching condition.

A baseball glove is illustrated in FIGS. 1 to 3 as the ball catching tool of the first embodiment.

This glove is arranged in that outer leather parts 2 on the rear side of a main body 1 of the glove (corresponding to the main body of the ball catching tool) are formed to cover the entire back of one's hand, whereas the outer leather parts 2 are provided with a main outer leather portion 3 on the finger side, an outer leather portion 4 on the hand inserting inlet side for receiving and supporting a wrist side of the back of the hand, and a joint outer leather portion 5 for blocking and jointing the main outer leather portion 3 and the outer leather portion 4 on the hand inserting inlet side.

The joint outer leather portion 5 is arranged in that the outer leather portion 4 on the hand inserting inlet side may be freely tightened and released from tightening with respect to the hand and is for blocking and jointing the main outer leather portion 3 on the finger side and the outer leather portion 4 on the hand inserting side. Three strip-like outer leather pieces 5A to 5C are aligned to extend from the main outer leather portion 3 on the finger side to the outer leather portion 4 on the hand inserting side such that longitudinal directions of the respective pieces are entirely aligned in width directions of the hand. The respective outer leather pieces 5A to 5C are fixed at both ends in longitudinal directions of the pieces without being tightly bonded in width directions of the hand.

The joint outer leather portion 5 is arranged in that both ends in longitudinal directions of the respective outer leather pieces 5A to 5C are fastened and fixed through sewing threads or leather strings while adjoining strip-like outer leather pieces 5A to 5C are connected on the rear side of the outer leather pieces 5A to 5C by means of a strap-like elastic sheet material 7. While the elastic sheet material 7 may be comprised of a fabric material coated with a plurality of thread-like rubber, the present invention is not limited to such an arrangement, and the number may alternatively be not less than two, and the shape is not limited to that as illustrated in FIG. 1 as well.

Figure 4:
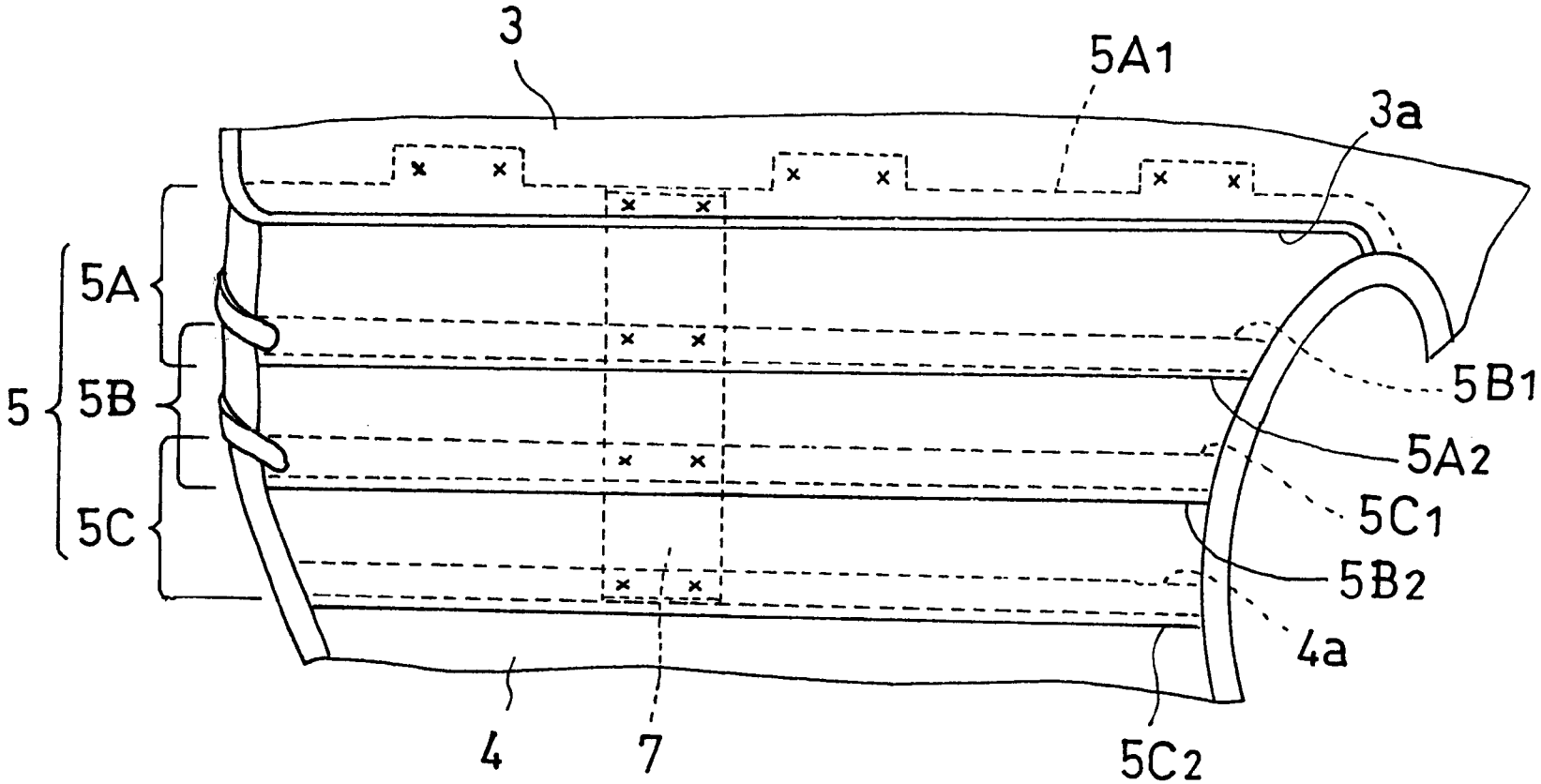
FIG. 4 is a rear view illustrating a joint outer leather portion of the ball catching tool.

Moreover, the joint outer leather portion 5 is arranged, as illustrated in FIG. 4 in enlarged form, in that, between the strip-like outer leather pieces 5A to 5C, a longitudinal directional edge 5B1 (5C1) on the finger side of the outer leather piece 5B (5C) that is farthest from the fingers is slipped below a longitudinal directional edge 5A2 (5B2) on the opposite side of the fingers of the outer leather pieces 5A (5B) that is closest to the fingers in a partially overlapping manner, and the outer leather piece 5A that is closest to the fingers is fixed to the main outer leather portion 3 with its longitudinal directional edge 5A1 on the finger side is slipped below the end edge 3*a* of the main outer leather portion 3 in a partially overlapping manner. The outer leather piece 5C that is farthest from the fingers is arranged to be connected to the outer leather portion 4 on the hand inserting side with an end edge 4*a* of the outer leather portion 4 on the hand inserting side being slipped below a longitudinal directional edge 5C2 on the opposite side of the fingers in a partially overlapping manner. In case of the joint portion 5, three portions of the longitudinal directional edge 5A1 on the finger side of the outer leather piece 5A that is closest to the fingers are fastened and jointed on the rear side of the main outer leather portion 3 as illustrated by the × marks in FIG. 4 while the longitudinal directional edge 5C1 on the finger side of the outer leather piece 5C that is farthest from the fingers and the end edge 4*a* of the outer leather portion 4 on the hand inserting side are connected and jointed on the rear side of the outer leather piece 5C and the outer leather portion 4 on the hand inserting side by means of the strap-like elastic sheet material 7. More particularly, the strap-like elastic sheet material 7 that is disposed on the rear side of the outer leather pieces 5A to 5C and the outer leather portion 4 on the hand inserting side with their longitudinal directions facing towards the width directions of the hand are sewn, as illustrated by the × marks in FIG. 4, to proximate of the longitudinal directional edges 5A1 to 5C1 on the finger side of the outer leather pieces 5A to 5C and proximate of the end edge 4*a* of the outer leather portion 4 on the hand inserting side.

The joint outer leather portion 4 does not need to be formed of the same material as the main outer leather portion 3 or the outer leather portion 4 on the hand inserting side, and the joint outer leather portion 4 may be formed of a different material than that of the main outer leather portion 3 or the outer leather portion 4 on the hand inserting side.

Next, the arrangement of enabling tightening and releasing the tightened condition of the outer leather portion 4 on the hand inserting inlet side with respect to one's hand will be explained.

That is, a belt through-passing hardware 11 for passing a belt 10 for tightening through is fastened at a position on the thumb side of the outer leather portion 4 on the hand inserting side by means of a strap-like fixing member 12, whereas the belt 10 for fastening is sewn and fixed at its base end side to a position downward of a base end side of a thumb sack 13 formed on a surface of the outer leather 2 and sheet-like fasteners 14, 15 are respectively attached to a base end side surface and a tip end side surface of the belt 10 for tightening.

For tightening the outer leather portion 4 on the hand inserting inlet side to one's hand, the belt 10 for tightening that has been passed through the belt through-passing hardware 11 is strongly pulled in a direction of arrow RA as illustrated in FIG. 1 and returned in a direction as indicated by arrow RB with a fulcrum being the belt through-passing hardware 11 so as to adhere and joint the sheet-like fastener 15 to the sheet-like fastener 14. On the other hand, when the tightening of the outer leather portion 4 on the hand inserting inlet side to the hand is to be released, the belt 10 for tightening is strongly pulled and flapped in a direction opposite to the direction as indicated by the arrow RB for tearing the sheet-like fastener 15 off from the sheet-like fastener 14.

For attaching the glove of the first embodiment, the hand is inserted into the main body 1 of the glove from the hand inserting inlet 16 and the outer leather portion 4 on the hand inserting inlet side is tightened and attached to the hand by means of the belt 10 for tightening. In this manner, it is possible to reliably prevent slipping off of the glove from the hand or positional shift thereof with respect to the hand.

As described above, when the glove is in a condition in which it is attached to a hand, the outer leather portion 4 on the hand inserting side that has been tightened to the hand may hardly change its position in a longitudinal direction of the hand with respect to the hand through the tightening force. However, since the joint outer leather portion 5 for blocking and jointing the main outer leather portion 3 on the finger side and the outer leather portion 4 on the hand inserting side is arranged in that the respective longitudinal directions of the pieces are entirely aligned in width directions of the hand such that three outer leather pieces 5A to 5C, which are aligned to extend from the main outer leather portion 3 to the outer leather portion 4 on the hand inserting side, are connected at both ends in longitudinal directions of the pieces while they are not firmly bonded with respect to the width directions of the hand, restraining force of the outer leather portion 4 on the hand inserting side acting on the main outer leather portion 3 that tries to deform in a warping manner accompanying the bending of each finger when performing catching will be restricted at the portion between the outer leather pieces 5A to 5C of the joint outer leather portion 5. That is, the main outer leather portion 3 will be substantially separated from the outer leather portion 4 on the hand inserting side which position is hard to be changed accompanying the catching operations so that the main outer leather portion 3 readily bends to the palm side to easily deform in a warping manner.

Consequently, catching may be performed upon firmly bending each finger so as to enclose the ball B by the inner leather 17 corresponding to the palm side of the main body 1 of the glove as illustrated in FIG. 3. Moreover, as for the outer leather pieces 5A to 5C of the joint outer leather portion 5 that is comprised of the outer leather pieces 5A to 5C, the outer leather pieces 5A to 5C exhibit a strength that is equivalent to that of the remaining leather portions so that the strength of the outer leather will not be partially degraded at the joint outer leather portion 5.

Adjoining outer leather pieces 5A to 5C are connected through the strap-like elastic sheet material 7 so that the outer leather pieces 5A to 5C are pulled towards the back of the hand through the elasticity of the strap-like elastic sheet material 7 when the fingers are bent. Consequently, the joint outer leather portion 5 will not escape but favorably fit the back of the hand to enable catching in a reliable manner. Since the strap-like elastic sheet material 7 exhibits elasticity, it is possible to prevent a case in which the outer leather pieces 5A to 5C are firmly bonded with respect to the width directions of the hand. Moreover, the strap-like elastic sheet material 7 will not be a hindrance in restricting the restraining force that acts from the outer leather portion 4 on the hand inserting side. The strap-like elastic sheet material 7 that is formed on the rear side of the outer leather pieces 5A to 5C will not be damaged since it is continuously protected by the outer leather pieces 5A to 5C.

In addition, the joint outer leather portion 5 is arranged in that portions between the outer leather pieces 5A to 5C, between the outer leather piece 5A that is closest to the fingers and the outer leather portion 3, and between the outer leather piece 5C that is farthest from the fingers and the outer leather portion 4 on the hand inserting side are comprised of partial overlaps of outer leather parts wherein the finger side is located upward while the hand inserting side is located downward. Since the partial overlaps of the outer leather parts are directed in a direction that is in line with a direction of movements of the opposite sided hand held in position or of movements of an approaching ball (forward direction), the outer leather pieces 5A to 5C will not stand on end to be a hindrance at the time of holding the ball catching tool in position or of performing catching.

The longitudinal directional edge on the finger side of the outer leather piece 5A that is closest to the fingers is fastened to the end edge of the main outer leather portion while the outer leather piece 5C and the outer leather portion 4 on the hand inserting side are connected by the strap-like elastic sheet material 7. When the fingers are bent, the outer leather piece 5A and the outer leather piece 5C are pulled to the side of the back of the hand which is affected by the mounting of the outer leather piece 5A to the main outer leather portion 3 and the elasticity of the strap-like elastic sheet material 7, the joint outer leather portion 5 will not escape but favorably fit the back of the hand so as to enable catching in a reliable manner.

Even though the outer leather piece 5A that is closest to the fingers is fastened at the main outer leather portion 3, restraining force acting from the outer leather portion 4 on the hand inserting side will be restricted until it reaches the outer leather piece 5A and even though the outer leather piece 5C that is farthest from the fingers is fastened at the outer leather portion 4 on the hand inserting side, the strap-like elastic sheet material 7 will not be a hindrance of restricting restraining force acting from the outer leather portion 4 on the hand inserting side since the strap-like elastic sheet material 7 connecting both members exhibits elasticity. The strap-like elastic sheet material 7 that is formed on the rear side of the outer leather piece 5C and the outer leather portion 4 on the hand inserting side will not be damaged since it is continuously protected by the outer leather piece 5C or the outer leather portion 4 on the hand inserting side.

Since the joint outer leather portion 5 is comprised of quite a small number of outer leather pieces 5A to 5C, namely three pieces, processing of the joint outer leather portion 5 will not be troublesome so that it may be easily manufactured. It should, however, be noted that the number of pieces comprising the outer leather pieces is not limited to three but may be comprised of a different number of pieces.

[The Second Embodiment]

Figure 5:
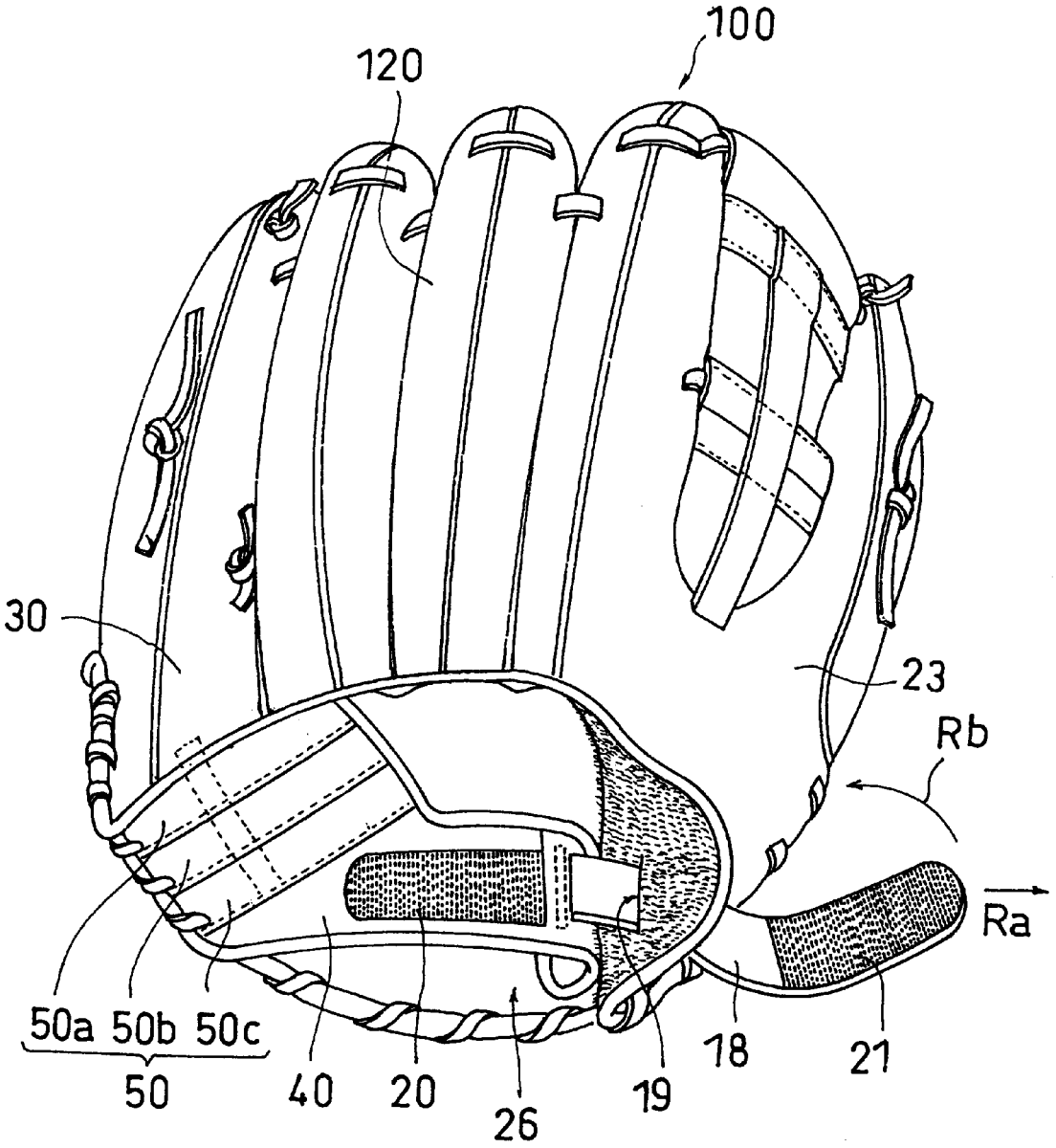
FIG. 5 is a rear view of a ball catching tool according to a second embodiment.

FIG. 5 illustrates a baseball glove as the ball catching tool of the second embodiment.

While the glove of the first embodiment is a ball catching tool of entirely closed type in which the entire back of one's hand is covered by the outer leather parts, the glove of the second embodiment is a ball catching tool of open type in which only a part of the back of one's hand is covered by the outer leather parts. Since the second embodiment is of substantially identical arrangement and of identical actions and effects as those of the first embodiment except for the following points, only the dissimilarities will be explained while explanations of similarities will be omitted here.

In case of the glove of the second embodiment, a joint outer leather portion 50 for blocking and jointing a main outer leather portion 30 and an outer leather portion 40 on the hand inserting side from among outer leather parts 120 is arranged in that it occupies approximately half of a side opposite to a thumb side in width directions of the hand while the remaining approximately half on the thumb side is in an open condition so that only a part of the back of one's hand is covered by the outer leather parts, and the belt-like outer leather portion 40 on the hand inserting side is arranged in that it may be freely tightened with respect to the hand.

The joint outer leather portion 50 is of similar arrangement and actions as those of the joint outer leather portion 5 as illustrated in FIG. 1 except for the point that a length of strip-like outer leather pieces in longitudinal directions is approximately half of that of the outer leather pieces 5A to 5C.

Next, the arrangement of enabling tightening and releasing the tightened condition of the outer leather portion 40 on the hand inserting inlet side with respect to one's hand will be explained. That is, a belt inserting slit 19 for passing a belt 18 for tightening through is formed through notching at a position downward of a base end side of a thumb sack 23 formed on a surface of the outer leather parts 120, whereas the belt 18 for tightening is sewn and fixed at a base end side to a position located closer to the thumb of the outer leather portion 40 on the hand inserting inlet side and sheet-like fasteners 20, 21 are respectively attached to a base end side surface and a tip end side surface of the belt 18 for tightening.

For tightening the outer leather portion 40 on the hand inserting inlet side to one's hand, the belt 18 for tightening that has been passed through the belt inserting slit 19 is strongly pulled in a direction of arrow Ra as illustrated in FIG. 5 and returned in a direction as indicated by arrow Rb with a fulcrum being the slit 19 so as to adhere and joint the sheet-like fastener 21 to the sheet-like fastener 20. On the other hand, when the tightening of the outer leather portion 40 on the hand inserting inlet side to the hand is to be released, the belt 18 for tightening is strongly pulled and flapped in a direction opposite to the direction as indicated by the arrow Rb for tearing the sheet-like fastener 21 off from the sheet-like fastener 20.

For attaching the glove of the second embodiment, one's hand is inserted into a main body 100 of the glove from a hand inserting inlet 26 and the outer leather portion 40 on the hand inserting inlet side is tightened and attached to the hand by means of the belt 18 for tightening. In this manner, it is possible to reliably prevent slipping off of the glove from the hand or positional shift thereof with respect to the hand.

[The Other Embodiments]

Figure 6:
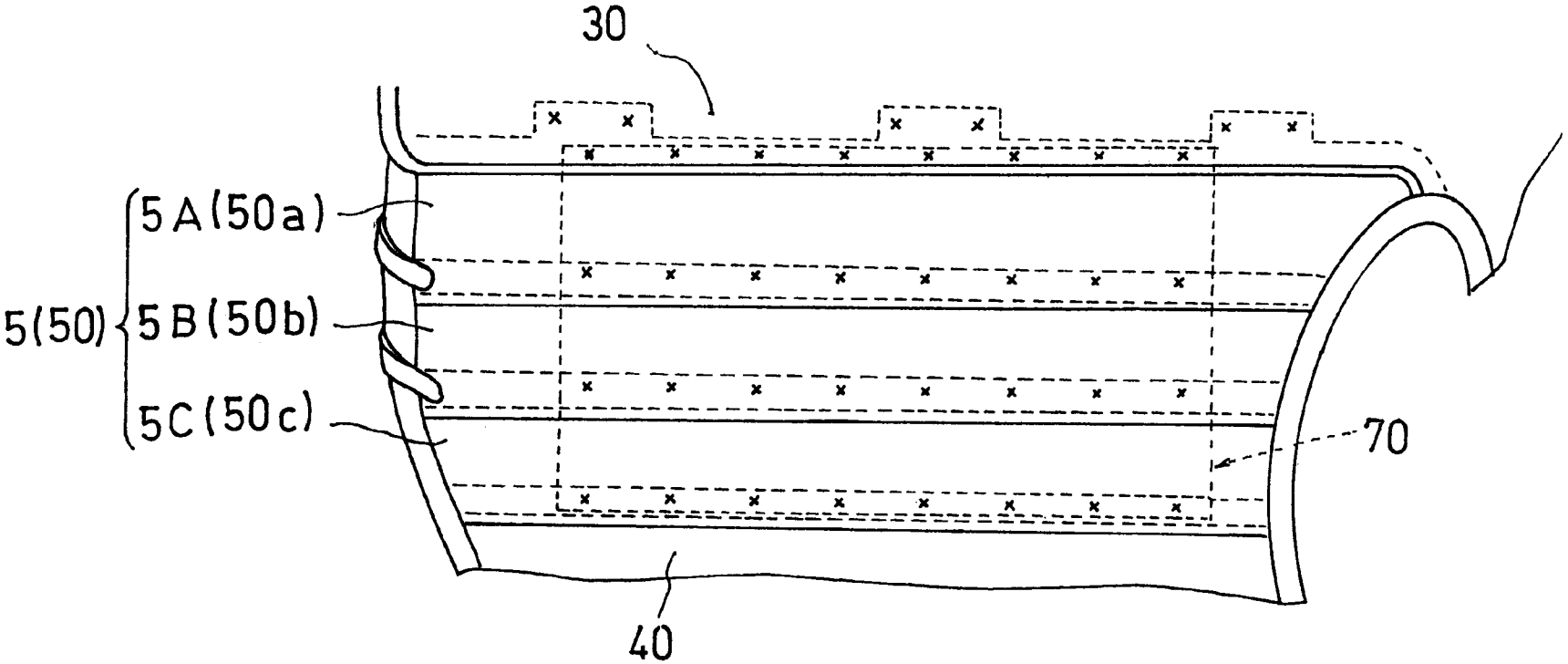
FIG. 6 is a rear view illustrating another form of the joint outer leather portion of the ball catching tool.

(a) Instead of connecting the outer leather pieces 5A to 5C (50*a* to 50*c*) of the joint outer leather portion 5 (50) or the outer leather portion on the hand inlet inserting side 4 (40) by means of the strap-like elastic sheet material 7 in the first embodiment and the second embodiment, it is alternatively possible to employ an arrangement in which these are connected by only a broad-width elastic sheet material 70 as illustrated in FIG. 6. That is, in the arrangement of FIG. 6, the longitudinal directional edges on the finger side of the outer leather pieces 5A to 5C (50*a* to 50*c*) are fastened to the broad-width elastic sheet material 70 disposed on a rear side of the outer leather pieces 5A to 5C (50*a* to 50*c*) and the outer leather portion on the hand inserting inlet side 4 as indicated by the × marks in FIG. 6 while the end edge of the outer leather portion on the hand inserting side 4 (40) is fastened as well.

It should, however, be noted that the joint outer leather portion 5 (50) is not to the above-described embodiments but differently shaped ones may be employed as well.

(b) The present invention is not only applicable to catcher's mitts or first baseman's mitts but it may also be applied to gloves, first baseman's mitts or catcher's mitts for use in playing softball as well.

What is claimed is:

1. A ball catching tool, comprising:

a main body of the ball catching tool with outer leather parts on a rear side being formed to cover a back of one's hand while an outer leather portion on a hand inserting inlet side for receiving and supporting a wrist side of the back of one's hand is arranged that it may be freely tightened or released from a tightened condition with respect to one's hand, and a joint outer leather portion that is provided at the main body of the ball catching tool for blocking and joining said outer leather portion on the hand inserting side and a main outer leather portion on a finger side, wherein the joint outer leather portion includes a plurality of strip-like outer leather pieces with longitudinal directions of the respective pieces being aligned to extend from the main outer leather portion on the finger side to the outer leather portion on the hand inserting side to be entirely aligned in width directions of the band and where said respective strip-like outer leather pieces are fixed at both ends in longitudinal directions of the pieces without being tightly bonded in width directions of the hand, wherein the joint outer leather portion is arranged in that adjoining strip-like outer leather pieces are connected on their rear side by means of a sheet material exhibiting elasticity.

2. The ball catching tool according to claim 1, wherein the joint outer leather portion is arranged in that the respective strip-like outer leather pieces are arranged such that longitudinal directional edges on the finger side of strip-like outer leather pieces that are located farther away from the fingers are slipped under longitudinal directional edges on the opposite side of the fingers of the strip-like outer leather pieces that are located closer to the fingers in a partially overlapping manner, wherein the outer leather pieces that are closest to the fingers are joined to the main outer leather portion in a condition in which their longitudinal directional edges on the finger side are slipped under an end edge of the main outer leather portion in a partially overlapping manner, whereas the strip-like outer leather pieces that are farthest from the fingers are joint to the outer leather portion on the hand inserting side in a condition in which an end edge of the outer leather portion on the hand inserting side is slipped under their longitudinal directional edges in a partially overlapping manner.

3. The ball catching tool according to claim 2, wherein the longitudinal directional edge on the finger side of the strip-like otuter leather piece that is closest the fingers is joined by fastening to the end edge of the main outer leather portion, and in which the longitudinal directional edge on the finger side of the strip-like outer leather piece that is farthest from the fingers and the outer leather portion on the hand inserting side are joined upon being connected on the rear side of the outer leather pieces through an elastic sheet material.

4. The ball catching tool according to claim 3, wherein the elastic sheet material is sewn to proximate of the longitudinal directional edges on the finger side of the respective strip-like outer leather pieces and proximate of the end edge of the outer leather portion on the hand inserting side.

5. The ball catching tool according to claim 4, wherein the elastic sheet material includes rubber materials.

6. The ball catching tool according to claim 1, wherein the joint outer leather portion occupies approximately half of a side opposite to a thumb side from among width directions of the hand while the remaining approximately half on the thumb side is in an open condition.

* * * * *